United States Patent [19]

Grasser

[11] Patent Number: 4,717,294

[45] Date of Patent: Jan. 5, 1988

[54] HOUSE-KEY CODE CUTTER

[75] Inventor: William M. Grasser, Lakewood, Ohio

[73] Assignee: Curtis Industries, Inc., Eastlake, Ohio

[21] Appl. No.: 933,992

[22] Filed: Nov. 24, 1986

[51] Int. Cl.[4] ..... B23C 1/16

[52] U.S. Cl. ..... 409/81; 83/917

[58] Field of Search ..... 30/355; 83/917; 409/81, 409/82, 83

[56] References Cited

U.S. PATENT DOCUMENTS

| | | | |
|---|---|---|---|
| 1,995,798 | 3/1935 | Curtis | 409/81 X |
| 2,626,663 | 1/1953 | Abrams | 409/82 X |
| 2,731,087 | 1/1956 | Cole | 409/82 X |
| 3,496,636 | 2/1970 | Lieptz | 409/81 X |

*Primary Examiner*—E. R. Kazenske
*Assistant Examiner*—Willmon Fridie, Jr.
*Attorney, Agent, or Firm*—Isler and Ornstein

[57] ABSTRACT

An inexpensive, portable hand-operated code key cutter is disclosed for reliable precision shear cutting of almost all common types of cylinder-lock keys comprising a body, a reciprocating punch, a pivoted hand lever, a cam-set holder movable vertically and laterally on said body and having a carriage for supporting the key blank, a punch rod with ratchet teeth and a driving pawl pivotally mounted on the hand lever near the main pivot axis, pawl-and-ratchet means for preventing retraction of the punch when the hand lever is released, a manual trip lever for releasing the pawls, a pivoted cam lever for lowering the cam-set holder in response to movement of the punch rod, and a cam lock for holding the cam lever in a fixed position during cutting. The house-key code cutter is capable of cutting to close tolerances and is remarkably well suited for use by the typical locksmith. The hand-carried shear cutter minimizes the time required for code selection, cutting and indexing and is ideal for on-site key changes at apartments, offices and motel rooms employing modern precision cylinder locks.

19 Claims, 32 Drawing Figures

HOUSE-KEY CODE CUTTER

The present invention relates to a high-speed manual cutting apparatus for precision cutting of keys of the type used in cylinder locks for homes, offices, apartments, motels and hotels and more particularly to a portable hand-operated code cutter capable of cutting almost all of the common cylinder-lock keys.

BACKGROUND OF THE INVENTION

In the key-cutting field, there are two types of machines for cutting replacement keys. One is a "duplicator" which utilizes an existing key as a pattern. The other is a "code cutter" which does not require an existing cut key but instead utilizes a key or lock number and coded information to establish the proper settings on the key cutting machine.

The standard equipment used by locksmiths is a duplicating machine having rotary filing or milling cutters for cutting the key blanks. The key duplicating machine has three basic parts comprising a pair of vises coupled together and moving in unison, a key guide, and a cutter wheel. One vise holds the original key and the other holds the key blank. The key guide reproduces the profile of the original key on the blank. The cutter wheel notches the key blank to the desired depth on orders from the key guide. The key duplicating machines operate on 110-volt AC or 12-volt DC current and are sometimes carried in a van or service truck.

By employing a set of coded depth keys, a locksmith can cut key blanks for a cylinder lock according to a code supplied by the lock manufacturer. Coded spacing keys are also employed for this purpose. The depth keys make it possible for the locksmith to use his duplicating key cutter to change the pin tumblers and keys of a cylinder lock according to code.

While code cutting on duplicating machines is time consuming and inefficient, some locksmiths have found this to be the most practical way to conduct their business. Heretofore there were no inexpensive portable house-key cutters which suited the needs of the ordinary locksmith. Small portable code cutters of the type disclosed, for example, in U.S. Pat. No. 3,633,451, with a reciprocating shear type punch, which have been used extensively for many years to cut automobile keys, are quite unsuitable for cutting house keys. Special rotary cutting machines are available for code cutting of house keys, but their size and cost make them unattractive to many locksmiths.**

** See the electric rotary code cutting machine of U.S. Pat. No. 4,521,142.

In recent years a special house-key code cutter was made available for certain brands of pin-tumbler cylinder locks and used for shear cutting of keys at some of the larger motels and apartments with a need for frequent key changes. However, this did not meet the needs of typical locksmiths servicing many different brands of locks. Also the code cutter could not match the precision of typical duplicating key cutters.

This special house-key code cutter lacked versatility and was not cost effective because of its limited utility. It did not provide the convenience and speed of the auto-key code cutters, exemplified by U.S. Pat. No. 3,633,451, and could not be used in connection with all of the common brands of cylinder locks. It was unacceptable to most locksmiths because of the need to purchase a number of separate key cutters to handle a number of different brands of locks. Too many different code cutters were required for the typical locksmith servicing a large number of different business establishments. Another problem with the special house-key cutter described above was the inability to provide an acceptable shear cut in some types of key blanks as used, for example, with certain Yale cylinder locks. Cutting of these key blanks required a rotating cutter as in the standard key duplicating machines.

Attempts to cut house keys with portable hand-operated code key cutters of the general type disclosed in U.S. Pat. No. 3,633,451 have been unsuccessful. The same is true of special code cutters of the type shown in U.S. Pat. No. 4,468,994. Such code key cutters are well suited for cutting ordinary automobile keys, but they cannot provide the reliable precision cutting required for modern house-key cylinder locks.

Modern cylinder locks are designed with security in mind and require keys cut to close tolerances. A high-quality duplicating key cutter with a rotary cutter can cut house keys within a tolerance range of 0.005 inch and provides precision cuts which are acceptable for most brands of cylinder locks. Heretofore hand-operated code cutters could not provide such precision cutting. Attempts to provide satisfactory cutting of house keys using auto-key code cutters of the type disclosed in U.S. Pat. No. 3,633,451 and U.S. Pat. No. 4,468,994 have been unsuccessful. Prior to the present invention it was assumed that hand-operated code key cutters similar to those used for cutting automobile keys could not provide the precision cutting required by locksmiths for servicing of security locks of the type used in modern motels and office buildings.

For the reasons mentioned above, the problems of locksmiths in cutting house keys by code have heretofore remained for many years without a practical solution.

Special electric machines are available commercially which are designed for code cutting and which employ motor-driven rotating key cutters as used in the duplicating machines. These machines provide the precision cutting required for modern cylinder locks but require a substantial capital investment. They do not provide the portability, convenience and versatility needed to permit a rapid, efficient, on-site key change at a typical office, apartment or motel room (See U.S. Pat. No. 4,521,142).

SUMMARY OF THE INVENTION

The house-key code cutter of the present invention involves a giant step forward in the area of code cutting and provides an admirable solution to the problems discussed above. The invention reduces to a minimum the time required for a locksmith to change keys at an office, apartment or motel room. One house-key code cutter with relatively inexpensive replaceable cam sets and inexpensive key holder attachments enables a typical locksmith to service many business establishments using many different brands of cylinder locks. The precision shear cuts provided by the key cutter of this invention are suitable for most coded security lock systems including sophisticated master-key systems as used in the larger motels and office buildings.

The key cutter of the present invention has a main body which supports a reciprocating punch rod with a key-shearing punch and an anvil aligned with the punch. The rod is reciprocated by a hand lever or trigger pivotally mounted on said main body. A conventional cam-set holder is mounted for vertical and lateral movement on said body and has a transversely movable indexing carriage for supporting the key blank and adjustable depth-of-cut gauging means for limiting the downward movement of the cam-set holder.

The key cutter has special means for advancing the punch including a series of axially spaced grooves in the punch rod defining a pair of ratchet teeth and a driving pawl pivotally mounted on the hand lever near the main pivot thereof so that movement of the hand lever or trigger from its advanced forward position to its retracted position advances the punch an axial distance corresponding to the axial spacing of said ratchet teeth. Releasable means such as a pawl-and-ratchet mechanism is provided for preventing retraction of the punch when the driving pawl reaches its forward position so that the driving pawl can move from one groove to the next when the trigger is released. A thumb-operated trip lever is provided to release both pawls at the end of the cutting operation.

The required high strength plus the desired close spacing between the main pivot axis of the hand lever and the pivot axis of the driving pawl are obtained by providing a yoke at the top of the lever to receive the pawl and a pair of side plates at opposite sides of the pawl with a pivot rod extending through the pawl between said side plates. The yoke is pivotally mounted on the main body of the key cutter by stub pins which terminate at the outer faces of the side plates.

Means are provided for lowering the cam-set holder including a cam lever pivotally mounted on said body and yieldable means for actuating the cam lever in response to forward movement of the punch rod. A releasable cam lock is provided for engaging the cam lever to maintain the cam-set holder in a fixed lowered position during cutting of the key blank.

In order to obtain the high precision required for modern cylinder locks, depth-gauging stop means of a special construction are provided having an upright stop pin which can tilt slightly to seat properly in each notch of the cam set. In this construction, a hollow adjusting screw is provided with an axially elongated hole to receive the lower portion of the stop pin which is loosely mounted and preferably embedded in a flexible polymeric or elastomeric material. A calibrated indicator dial is provided adjacent the screw to facilitate rapid fine adjustments when cutting keys for security locks requiring close tolerances.

An object of the invention is to provide a simple reliable manual house-key code cutter which provides precision shear cutting of key blanks and which can be used with almost all of the common brands of modern pin-tumbler cylinder locks as used in modern hotels, motels, apartments and office buildings.

These and other objects, uses and advantages of the invention will become apparent from the drawings and description which follow.

BRIEF DESCRIPTION OF THE DRAWINGS

In the drawings:

FIGS. 1 to 30 of the drawings are drawn substantially to scale to facilitate an understanding of the invention.

DEFINITIONS

Figures 5, 5A, 14A, 18, 19, 20, 21:
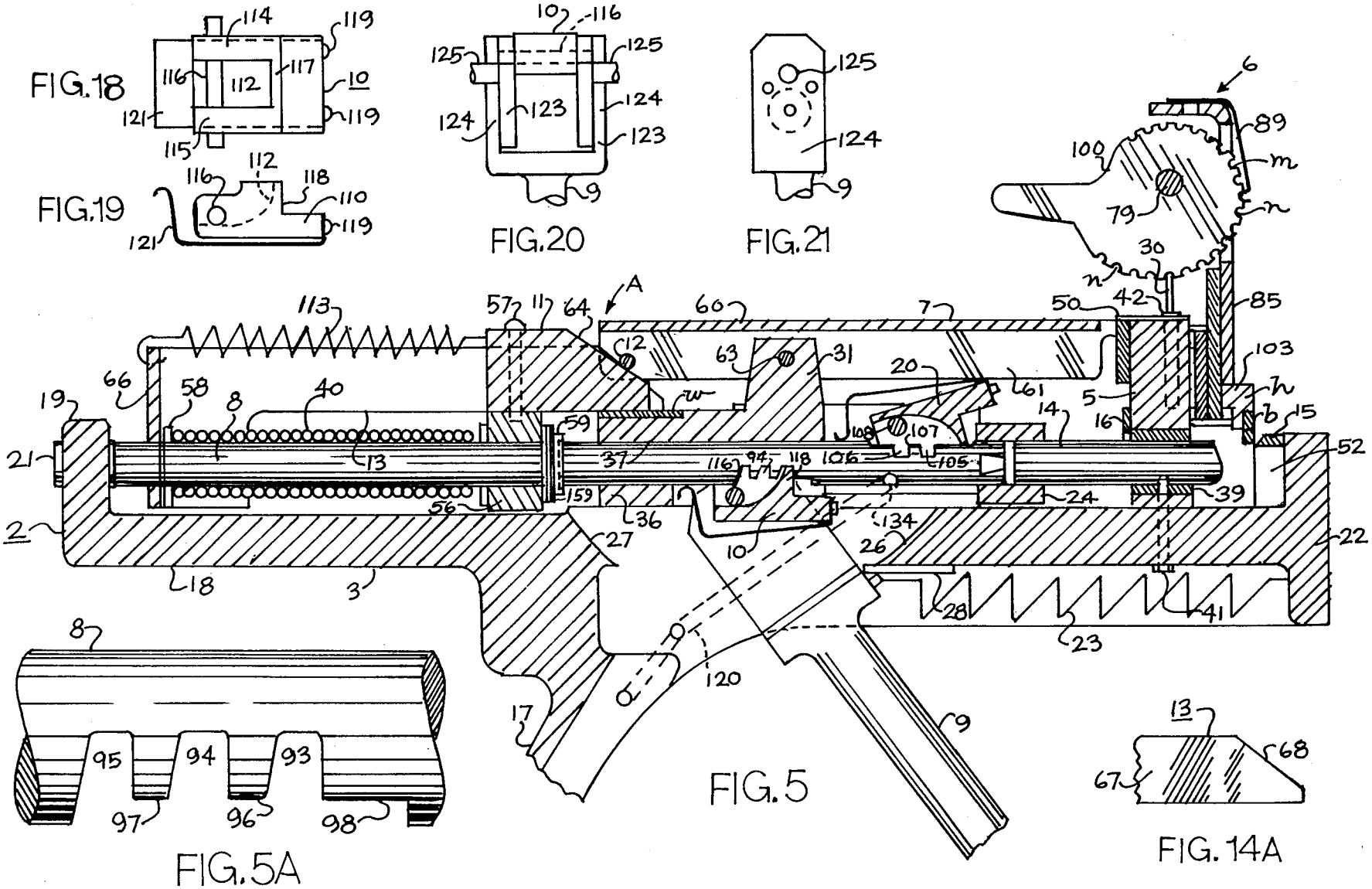
FIG. 5 is a vertical sectional view with parts omitted showing the position of the parts when the punch rod is retracted.
FIG. 5A is a fragmentary side view of the punch rod on a larger scale.
FIG. 14A is a fragmentary side view of the cam lock.
FIGS. 18 and 19 are top and side views of the driving pawl and its associated spring on a reduced scale.
FIGS. 20 and 21 are fragmentary end and side elevational views on a reduced scale showing the trigger assembly including the handlever and driving pawl.

As used in the specification and claims, the term "vertical" refers to the position of a part when the code cutter A is in a position as in FIG. 5 with the axis of the punch rod 8 horizontal and the side faces of the parts 3, 4 and 5 in vertical planes. The various parts are described as if the code cutter was fixed in such a position.

Unless the context shows otherwise, the terms used herein have normal meanings as understood by locksmiths. The term "key blank" refers to a blank to be cut. The term "cylinder lock" refers to a pin-tumbler cylinder lock. The term "house key" covers keys of the type used in hotels, motels and office buildings as well as those used in homes.

A "portable" key cutter is one of relatively light weight, usually under 30 pounds, which can easily be carried to the work site by one person.

The term "tolerance range" refers to the overall range of acceptable dimensions or sizes. Thus a tolerance range of 0.008 inch is the same as a tolerance of ±0.004 inch.

DESCRIPTION OF THE PREFERRED EMBODIMENTS

Referring to FIGS. 1 to 30 of the drawings, which are drawn substantially to scale, there is shown a house-key code cutter A constructed in accordance with one of the preferred embodiments of the invention.

The key cutter A has a rigid metal body 2 which includes a handle casting 3, a slide block 4, and an upright support block 5. The blocks are rigidly mounted on the casting by screws or other means. The casting 3 and the slide block 4 are preferably formed of an aluminum alloy. Other metal parts can be formed of steel if desired to provide strength, durability or wear resistance.

A conventional cam-set holder 6 is mounted on the upright block 5, and a special cam lever 7 is pivotally mounted on the slide block to effect lowering of said assembly. The lever is operably connected to a long cylindrical punch rod 8 which is mounted for axial sliding movement in the slide block 4. The punch rod is actuated by a hand lever 9 pivotally mounted on the body 2 and a driving pawl 10 pivotally mounted on the lever (FIGS. 20 and 21).

A pusher cam 11 is mounted for axial sliding movement on the punch rod and is engageable with a lateral cylindrical follower rod 12 of the lever 7 to lift the rear of the lever when the rod is advanced. As shown, a long U-shaped cam lock 13 is mounted to slide axially on the rod 8. The cam lock holds the cam lever against movement as the key blank is being cut by advancing movement of the punch 14 into the anvil 15.

The handle casting 3 is shown in FIGS. 1 to 5 and includes a depending handgrip portion 17, a rear extension 18 with an upstanding end portion 19 for receiving an adjustable threaded set screw or stop 21, and a narrow front portion 22 with an upper part to hold the anvil 15 and a lower part to hold the trigger spring 23. The casting 3 has a large rectangular opening 25 to receive the upper portion of the hand lever or trigger 9 and has inclined surfaces 26 and 27 at the front and rear of the opening. An adjustable trigger stop 28 is provided at the lower end of the surface 26 for engaging the lever 9 when it is in its forward "release" position. A helical tension spring 22 serves as the "trigger" spring to hold the lever 9 against the trigger stop 28 as shown in FIG. 5.

Figure 8:
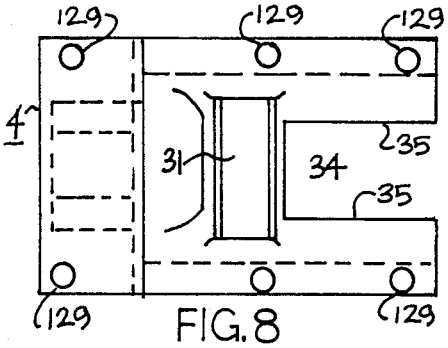
FIGS. 8, 9 and 10 are top, side and end views of the slide block of the cutter on a reduced scale.
Figure 9:
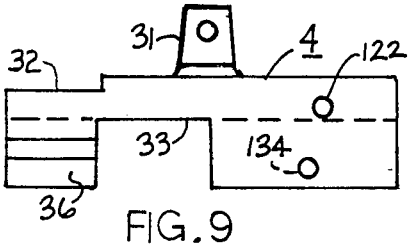
Figure 10:
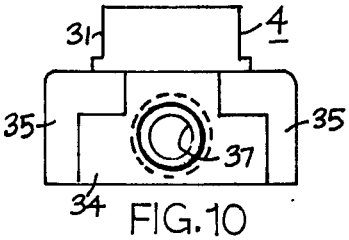
Figure 30:
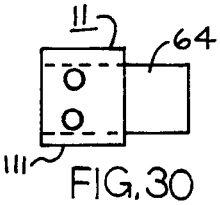
FIG. 30 is a top view of the cam which moves the cam lever.

The slide block 4 is rigidly mounted on the handle casting 3 of the body 2 by six vertical screws 29 which extend through openings 129 of the block. The block and the casting are preferably formed of an aluminum alloy or other lightweight material. The block is shown in FIGS. 8, 9 and 10 and has an upwardly projecting top portion 31; a flat portion 32 of a size to receive a steel wear plate w and a lower recess 33 of rectangular shape separating the front and rear portions of the block, and a front rectangular opening 34 located between front portions 35 of L-shaped cross section. The rear portion 36 of the slide block has a cylindrical bore 37 to receive the reciprocating punch rod (FIGS. 5 and 10).

An upright rectangular support block 5 is rigidly mounted on the casting 3 and has a cylindrical bore to receive the punch 14, which is rigidly and detachably connected to the rod 8 by an annular collar 24. A cylindrical bushing 39 is provided in said bore to guide the punch and to reduce wear. A similar bushing may be provided for the same purpose in the bore 37 of the slide block. This assures that the rod and punch are properly supported for axial movement and that the punch is in precise alignment with the aperture 52 of the anvil 15 during key cutting.

Figure 24:
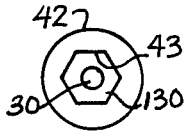
FIG. 24 is an enlarged top view of the adjusting screw and stop pin.
Figure 22:
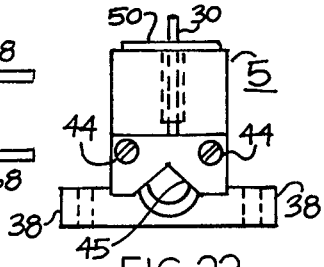
FIGS. 22 and 23 are front and side elevational views on a reduced scale showing the upright support block including the punch guide.
Figure 23:
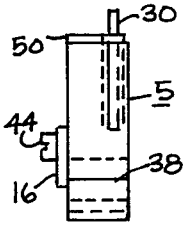

The upright support block 5 is shown in FIGS. 22 and 23 and has optional laterally projecting portions 38 which are attached to the casting 3 by a pair of vertical screws 41 (FIG. 5). The block has an internally threaded opening to receive an elongated set screw 42 having an axially elongated opening 43 of hexagonal cross section (FIG. 24). The lower portion of the stop pin 30 is loosely mounted in the hexagonal opening and is preferably embedded in a deformable or elastomeric matrix 130 of polymeric material, such as silicone rubber, which substantially fills the opening 43.

A flat removable dial plate 50 is rigidly mounted on the flat top surface of the block 5 is marked with suitable indicia to facilitate micro-adjustments of the set screw 42. The plate has a small circular opening to receive the set screw and permit adjustment with a suitable wrench.

A flat punch guide 16 is rigidly mounted on the flat vertical rear face of the block by a pair of screws 44. The guide has a 90-degree V-shaped opening 45 which exactly fits the top of the punch and assures precise alignment of the punch with the opening of the anvil 15. The guide prevents angular movement of the punch about its axis.

Figure 25:
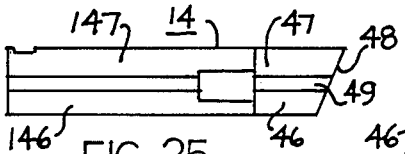
FIGS. 25, 26 and 27 are top, side and end views of the punch.
Figure 27:
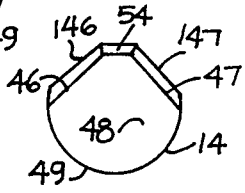
Figure 26:
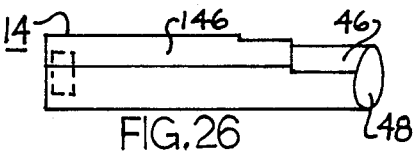

The punch 14 as shown in FIGS. 25, 26 and 27 and has flat inclined upper faces 46 and 47 which slidably engage the anvil and similar faces 146 and 147 which slidably engage the punch guide as the punch is advanced toward its forward position. The flat front face 48 of the punch is inclined (FIG. 25) to facilitate shear cutting and to reduce the force required to advance the punch. The cylindrical bottom surface 49 has a curvature to fit the bushing 39.

Figure 28:
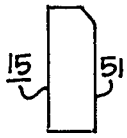
FIGS. 28 and 29 are end and front views of the anvil.
Figure 29:
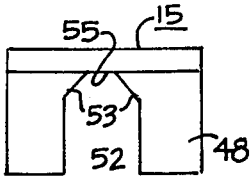

The anvil 15 is shown on FIGS. 28 and 29 and has a flat vertical key-engaging face 51 and a central opening 52 with inclined surfaces which are precisely aligned with the inclined upper surfaces 46 and 47 of the punch. As shown the flat upper face 54 of the punch is aligned with the flat horizontal upper surface 55 of the anvil.

The punch 14 is axially aligned with the punch rod and rigidly connected thereto by the collar 24 so as to function as if it were an integral part of said rod. However, the code cutter A is designed to permit rapid removal or replacement of the punch and the anvil whenever this becomes desirable due to wear or a need for a different size and shape. Such replacement can be effected easily without disassembling the drive mechanism or other substantial elements of the cutter unit A. For example, the set screw 124 of the collar 24 and the screws 44 of the punch guide 16 are merely loosened when removing the punch 14 for resharpening. Only the two screws 115 of the anvil 15 need be removed from the front portion 22 of the casting 3 when removing the anvil for resharpening.

The punch rod 8 is cylindrical and extends through an internally cylindrical block 56 which slides axially on the rod and is rigidly connected to the cam 11 by two screws 57. A main helical spring 40 fits on the rod between the block 56 and a flat ring 58 which is rigidly connected to the rod. A similar ring 59 is rigidly connected to the rod at the front of the block 56 (FIG. 5) to limit forward movement of the block. One or more flat annular washers 159 may be mounted on the pusher rod 8 on one or both sides of the block 56 to serve as spacers for locating the block in the most desirable position.

Figure 11:
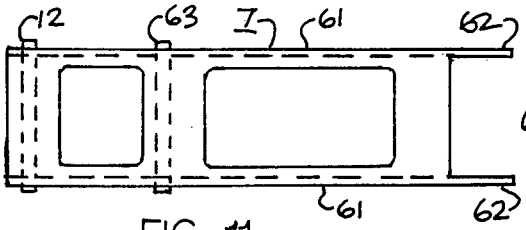
FIGS. 11 and 12 are top and end views of the cam lever on a reduced scale.
Figure 12:
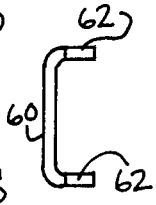

The cam lever 7 shown in FIGS. 5, 11 and 12 is in the form of a channel with a flat rectangular top portion 60 and narrow side portions 61 with flat front fingers 62 projecting forwardly from the top portion for engagement with a pair of cylindrical projections 162 at opposite sides of the cam-set holder 6. The lever is mounted on a horizontal pivot pin 63 extending laterally through the slide block at 31 between the side portions 61.

Figure 1:
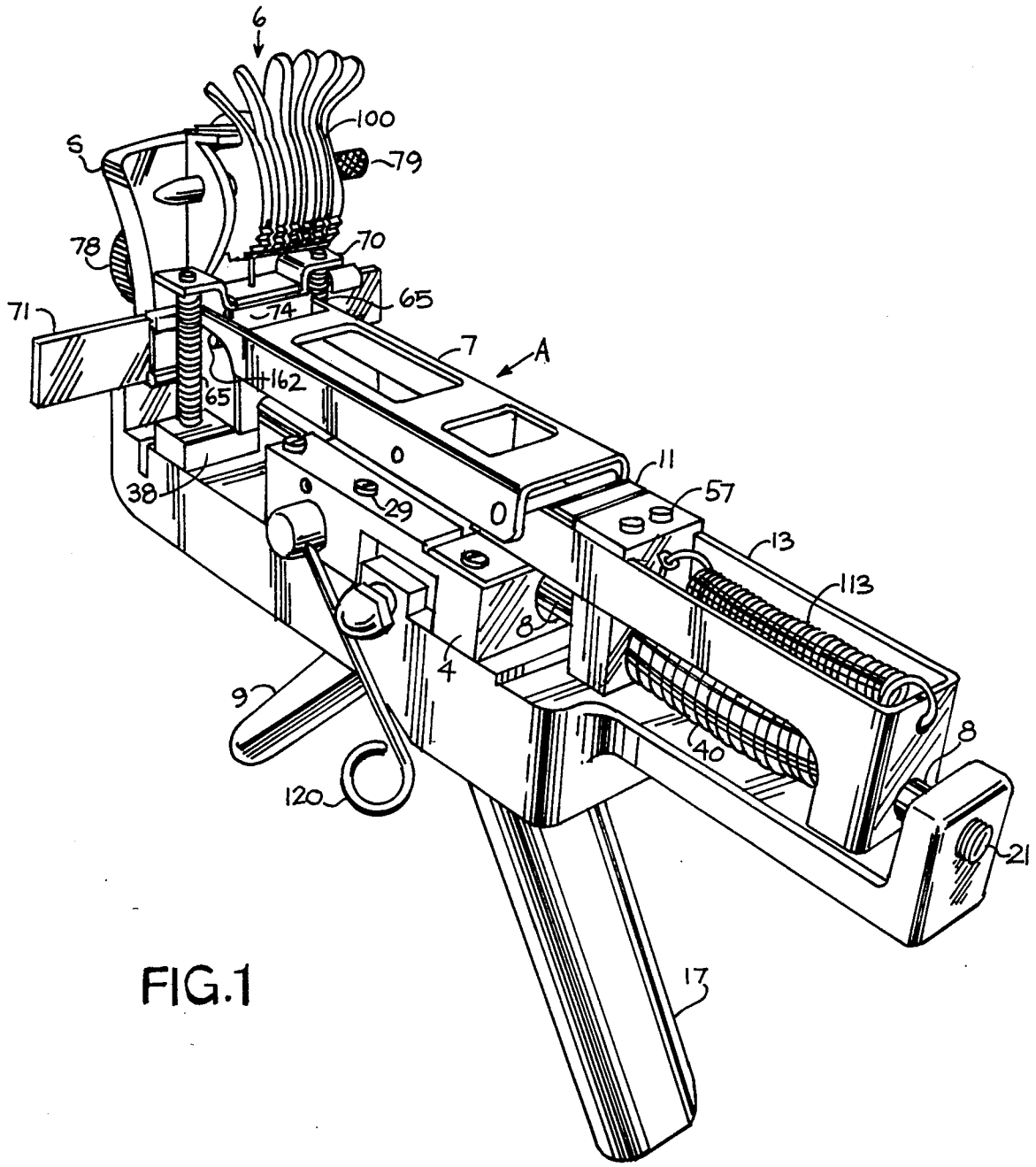
FIG. 1 is a perspective view showing a house-key code cutter made according to the invention.

The follower rod 12 is rigidly mounted on the rear portion of the cam lever 7 for engagement with the flat upper inclined surface 64 of the pusher cam 11. The rod is parallel to the pin 63 and to the surface 64 and has an axis in a vertical plane perpendicular to the axis of the punch rod 8. Forward movement of the cam against the follower caused by advancing movement of the punch raises the rod 12 and lowers the front fingers 62 to cause the projections 162 and the cam-set holder 6 to move downwardly. This compresses the two vertical helical lift springs 65 located above the base portions 38 of the upright block 5 (FIG. 1).

Figures 2, 3, 4, 15, 16, 17:
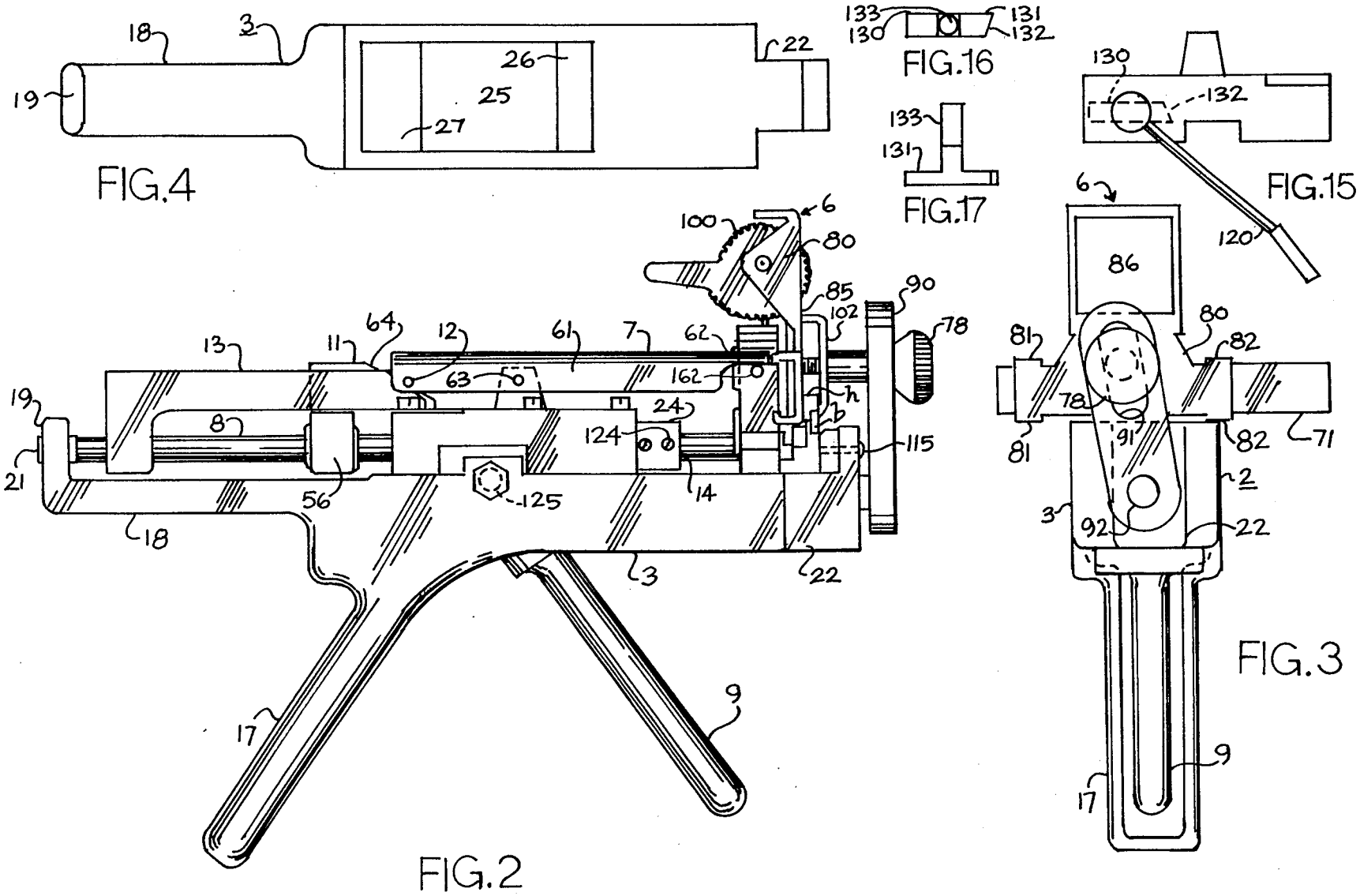
FIG. 2 is a side elevational view of the cutter on a reduced scale with parts omitted.
FIG. 3 is an end elevational view of the cutter.
FIG. 4 is a top view on a reduced scale showing the handle casting.
FIG. 15 is a side view showing the slide block, the trip handle, and the pawl-releasing means.
FIGS. 16 and 17 are end and side views of the trip lever on a reduced scale.
Figure 13:
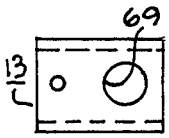
FIGS. 13 and 14 are end and top views of the cam lock on a reduced scale.
Figure 14:
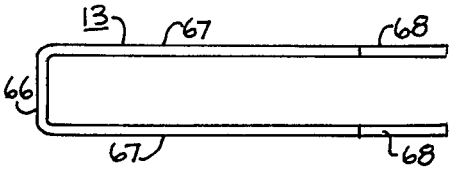

FIGS. 2, 13 and 14 show the U-shaped cam lock 13 provided for holding the cam-set holder 6 in its lowermost position. It has a flat vertical end portion 66 and flat elongated side portions 67 with flat inclined upper faces 68 which are engageable with the follower 12 of the cam lever. The faces 68 are located in a plane parallel to the axis of the follower. The portion 66 has a circular hole 69 of a size to receive the rod 8 and is mounted on the rod to slide axially. The cam lock is guided by flanges 111 of the cam 11, which engage the flat upper surfaces of the side portions 67, and by the flat wear plate w.

A helical tension spring 113 extends between the end portion 66 and the cam 11 to pull the cam lock 13 into engagement with the follower 12 when the cam is advanced.

Figure 6:
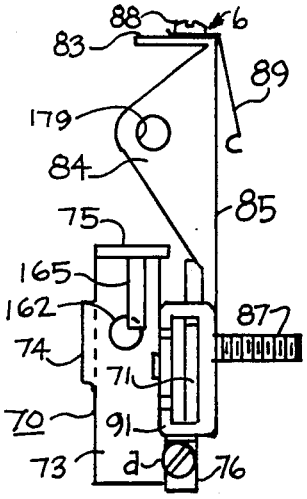
FIGS. 6 and 7 are side and front elevational views showing the cam-set holder and carriage of the cutter.
Figure 7:
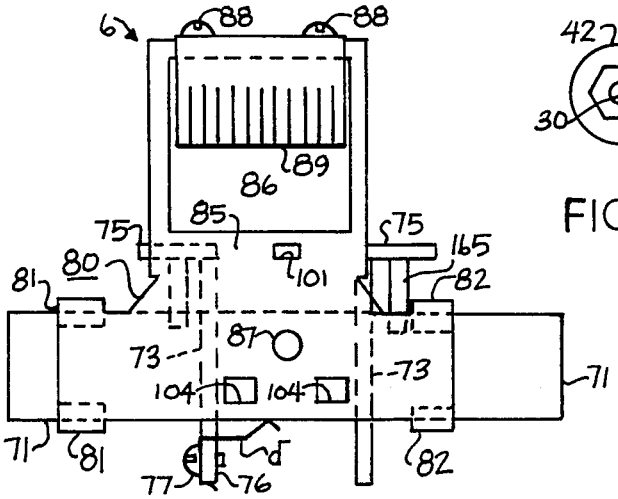

The cam-set holder 6 is mounted for lateral sliding movement on a track slide assembly 70 mounted for vertical movement on the upright block 5. The holder 6 and the assembly 70 are shown in FIGS. 6 and 7 and provide depth-of-cut gauging means similar to that disclosed in U.S. Pat. No. 3,633,451. The assembly includes a guide rail or track slide 71 in the form of a flat horizontal rectangular bar with its faces in a plane perpendicular to the punch axis (FIG. 2). The track 71 is rigidly mounted on a bent sheet metal member 72 having parallel rectangular side portions 73 connected by a narrow rear wall portion 74 and having square horizontal spring-engaging flanges 75 and a lower projection 76 which carries a carriage-spring screw 77. Each side portion 73 has a circular projection 162 which engages the finger 62 of the cam lever 7.

The cam-set holder 6 comprises a unitary sheet metal carriage or support member 80 having two pairs of tabs 81 and 82 at its opposite sides which are bent around the track 71 to guide the holder 6 for sliding movement on the track. The member 80 is bent to provide a top flange 83 and a pair of parallel triangular side flanges 84 for supporting a selected cam set 100. A hole 179 is provided in each flange to receive the removable horizontal shaft 79 which supports the cam set. The flat main wall 85 has a square opening 86 to receive each cam set and has an integral threaded stud 87 to receive the key-clamp knob 78 (FIG. 2). A small hole 101 is provided to receive the top tab of the key clamp 102.

A pair of screws 88 extend through the flange 83 to connect a slotted rectangular detent spring 89 to the cam-set holder 6 in alignment with the opening 86. Although the basic features of the cam-set holder and the track assembly are conventional and generally similar to what is disclosed in U.S. Pat. No. 3,633,451, there are substantial differences. The holder 6 is biased in an upward direction by the helical lift springs 65 which extend between the flanges 75 and the laterally extending base portion 38 of the block 5. The springs may be held in position by vertical pins, such as the pins 165 carried on the flanges 75.

A conventional carriage detent spring supported by the extension 76 of the member 72 is engageable with regularly spaced notches on the bottom of the brass key holder 2 to locate the key for each cut as in the key cutter of the aforesaid patent. The operator immediately becomes aware when the detent spring enters each notch. Each key holder 2 is a short rectangular metal piece machined to fit a particular brand of key blanks and detachably mounted on the front wall 85 of the cam-set holder 6 as shown in FIG. 2. The holder has two rectangular projections 103 (FIG. 5) which fit into rectangular openings 104 of the wall 85 (FIG. 7). The holder is accurately located by said projections when it is clamped in place against the wall 85 by tightening the knob 78 against the clamp 102.

While manual rack-and-pinion means may be provided as in the key cutter of said U.S. Pat. No. 3,633,451 to move the holder 6 on the track 83 to indexed positions as determined by the notches of the key holder 2, indexing can be carried out quickly and more conveniently with a thumb-operated shifter S at the front of the cutter as shown in FIG. 1. A simpler form of the shifter 90 shown in FIGS. 2 and 3 has an elongated slot 91 to receive the key-clamp knob 78 and a cylindrical hole to receive a short pivot shaft 92. The slot allows the shifter to swing to desired positions during indexing.

The house-key code cutter of this invention has special means for advancing the punch. In the embodiment of the invention shown in FIG. 5, the punch rod 8 is provided with three axially spaced grooves 93, 94 and 95 defining two ratchet teeth 96 and 97 engaging the driving pawl 10 below the rod. A shallow flat notch 98 may be provided when necessary to obtain clearance for movement of the pawl. The ratchet teeth are preferably shaped as shown in FIG. 5A with a flat surface at the front of each of said grooves perpendicular to the axis of rod 8.

Releasable means are provided for resisting retraction of the punch when the driving pawl approaches its forewardmost position so that the punch does not retract when the hand lever 9 is released. This allows the driving pawl 10 to move from the first groove 93 to the second groove 94 as the hand lever 9 moves back against the trigger stop 28. In the embodiment shown, such releasable means comprises pawl-and-ratchet means including a catch pawl 20 which may be similar to or identical to the driving pawl 10. The punch rod 8 has two axially spaced grooves 105 and 106 defining a single ratchet tooth 107. As shown herein clearance is provided by cutting away a portion of the rod 8 to reduce the depth of said grooves and to form flat shallow recesses at the front and rear of the grooves. The need for clearance depends on the location of the pivot shaft (108) for the pawl and the size of the pawl.

The preferred construction of each pawl is indicated in FIGS. 18 and 19. As shown the pawl has a rectangular body with a forward projecting portion 110 and a recess 112 of uniform width located between side portions 114 and 115. The latter portions have cylindrical holes which receive a pivot shaft 116. The cross section of each pawl from one side of the recess 112 to the other may be uniform and is preferably as indicated in FIGS. 5 and 19. The width of the recess is preferably about the same as the diameter of the punch rod 8 so that the ratchet-engaging portion 117 of the pawl at the front of the recess can move into and out of the ratchet grooves.

The portion 117 has a flat front surface 118 which is perpendicular to the axis of punch 8 in its operating position (i.e., when the pawl 10 is seated in the ratchet groove as shown in FIG. 5). The rear surface of portion 117, which engages the inclined front face of the ratchet tooth is curved or tapered to assist in moving the pawl out of the ratchet groove at the appropriate time when the trip handle 120 is actuated and when there is relative forward movement of the punch with respect to the pawl due to release of the hand lever 9.

The forward portion 110 of each pawl has internally threaded holes to receive a pair of screws 119 which rigidly attach the pawl to a pawl spring 121 having a width slightly less than that of the pawl. The inturned rear portion of the pawl spring engages the cylindrical surface of the punch rod 8 so that the ratchet-engaging portion 117 is biased toward and held against the rod (FIG. 5).

The catch pawl 20 fits in the opening 34 of the slide block 4 with its pivot shaft 108 in the cylindrical holes 122 of said block (FIG. 9). The driving pawl 10 fits between an aligned pair of flat side plates 123 carried by the hand lever 9 as shown in FIG. 20.

The upper portion of the hand lever 9 is bifurcated to provide a yoke having flat portions 124 which are rigidly connected to the side plates 123. The yoke is pivotally mounted on the body 2 to swing about a horizontal axis by a pair of coaxial stub shafts 125 which fit in cylindrical holes of the portions 124. The pivot shaft 116 of the driving pawl 10 fits in similar cylindrical holes of the side plates 123 with its axis parallel to the shaft 79 and parallel to the pivotal axis of the lever 9 at 125. The shaft 116 is free to move angularly relative to the portions 124 when the hand lever is moved.

The special construction shown in FIG. 20 is needed for high force multiplication and makes it possible for the spacing between the pivotal axis of the shafts 116 and 125 to be a small fraction of an inch, such as from 0.2 to 0.3 inch. Thus a small squeezing force on the hand lever is multiplied many times and is sufficient to force the punch through the thicker portions of a house key blank when making deep cuts in the key.

FIGS. 15, 16 and 17 show the T-shaped manual trip means 130 for releasing both of the pawls 10 and 20 at the end of each cutting cycle. Such means comprises a trip lever 131 with an inclined flat end surface 132 and an integral shank with a cylindrical shaft portion 133 which is connected to the external wire tip handle 120.

The shaft portion 133 is rotatably mounted in the cylindrical hole 134 of the slide block 4 (FIG. 9) with its axis parallel to the axis of the shafts 116 and 125 and is located between two pawls so that a small angular movement of the thumb-actuated handle 120 moves the trip lever 131 from a normal horizontal position and causes the opposite ends of said lever to move into engagement with both of the pawls 10 and 20. Such angular movement causes the rod-engaging portions 117 of the pawls to move radially outwardly, thereby releasing them from the punch rod and allowing the main spring 40 to retract the rod into engagement with the stop 21.

The code cutter A shown herein is capable of providing precision key cutting for the common brands of pin-tumbler cylinder locks, such as Yale, Schlage, Kwikset, Weiser, Falcon, Dexter, Weslock, Ilco, Segal, Lockwood, Arrow, Elgin and Sargent. Various types of cylinder keys can be cut including single or double-shoulder keys, keys without shoulders, narrow blade keys and double-bitted keys.

The locksmith art is thoroughly described in "Locks and Locksmithing" (Second Edition) by C.A. Roper (1983). As indicated in this book a pin-tumbler cylinder lock has a revolving plug and a cylinder, the space between the shell and the plug being called the shear line. The key raises the pin tumbler to the shear line and allows the plug to rotate. The plug contains a keyway with 4 to 8 or more tumbler chambers. The cylinder shell carries a matching set of tumbler chambers. The pin tumblers come in a variety of sizes and shapes and are color coded according to length. A good cylinder lock often will require a key cut within a tolerance range of 0.010 or less.

A typical locksmith stocks key blanks and pin tumblers for most if not all of the common brands of cylinder locks and has a precision duplicating key cutting machine, such as a Jet-Set KD-50 sold by Taylor Lock Company. A locksmith employing the house-key code cutter A of the present invention will also stock cam sets for various brands of cylinder locks (see cam set 100). Some cam sets will be suitable for a plurality of different brands (e.g., Schlage and Dexter or Kwikset and Weiser). The cam sets for one brand of cylinder lock will often be suitable for other brands made by the same manufacturer.

The locksmith using the code cutter A will carry a variety of key holders (h) with projections 103 which fit the holes 104 of the wall 85 (FIG. 7). Each key holder h, like the key holder of U.S. Pat. No. 3,633,451, has indexing notches on its bottom surface with a spacing corresponding to the axial spacing of the cams c in the set. These notches are of a size to receive the upwardly projecting portion of the carriage detent spring d.

A special key holder h is provided for each different type of key blank with ribs that precisely fit the grooves of the key blank to assure proper positioning of the key during cutting. The flat side of the key is located to engage the anvil, thereby locating the bow of the key on either the right or left side. The key holder h often has a built-in flat metal strip which serves as a stop to engage the end of the key and assure that the key is properly positioned during cutting. This may be necessary where the key blank does not have a shank or shoulder to serve the same purpose.

The code cutter A is designed so that the key holder h accurately locates the key blank for precision cutting with the flat side of the key engaging the flat vertical surface of the anvil 15. In the case of a key blank, such as that for the common Yale Y-1 lock, without such a flat side, the cutting is not so precise because of slight deflection of the key relative to the anvil. However, the key cutter of this invention minimizes such deflection and can provide satisfactory shear cutting of the Yale Y-1 keys. That is not the case with any previously known key cutter.

The operation of the code cutter A shown herein is simple and permits key cutting by code in a minimum period of time. The first step is to select the proper key blank, key holder and cam set for the particular brand of lock. The cam set 100 is replaced with the newly selected cam set after removing the pin 79 from the holder 80. The key holder h is replaced after removing the key-holder clamp 102 and the knob 78. The key blank b to be cut is placed in the key holder h, the key holder is mounted on the wall 85 at the holes 104, and the holder and the blank are clamped in position by the clamp 102 and the knob 78.

The proper code for cutting of the key is selected and all of the cams of the cam set (100) are moved to the positions corresponding to the selected code. An index mark on the cam-set holder 6 is aligned with a start arrow (not shown) on the track slide 71, and the first cut is initiated by squeezing the hand lever or trigger 9 toward the handgrip portion 17.

The movement of the trigger causes the pawl 10, located in the groove 93, to drive the punch rod forward and to compress the main spring 40. As the punch rod is advanced by the pawl the spring forces the cam pusher 56 and the cam 11 toward the slide block 4 and drives the cam surface 64 against the follower 12 so that the front portion of the cam is wedged between the follower and the flat wear plate w. This raises the follower 12 and lowers the fingers 62 of the cam lever 7 to force the projections 162 and the cam-set holder 6 down until the notch n of one depth cam c contacts the adjusting pin 30. The downward force is sufficient to deflect the pin to the extent necessary to allow it to seat properly in the notch n.

The cam-set holder 6 reaches its lowermost position against the pin 30 before the end of the first stroke. At this point the holder 6 can travel no further and additional forward movement of the pawl 10 and the punch rod further compresses the main spring 40 without moving the cam 11.

As the cam 11 is moved forwardly at the beginning of the stroke, the tension spring 113 pulls the cam lock 13 into engagement with the follower and causes it to become wedged between the follower and the wear plate w. This locks the cam lever 7 and the cam-set holder 6 in position so that they do not move during key cutting. Thus the holder 6 is locked in its lowermost position with the adjusting pin 30 properly seated in the associated notch n of the depth cam.

As the punch rod approaches its forwardmost position at the end of the first stroke, the second pawl 20 falls into place in the groove 105 to prevent retraction of the punch rod by the main spring. The trigger 9 is then released and the flat surface 118 of pawl 20 engages the flat front surface of groove 105 to hold the punch rod against movement. The grooves 105 and 106 are preferably shaped like the grooves 93 and 94 of FIG. 5A with their front faces perpendicular to the punch axis.

At the end of the first stroke, the key blank b is in position to be cut with the cam-set holder 6 locked in its lowermost position and the front of the punch 14 adjacent to and almost engaging the key blank. At this time the trigger 9 is released and is pulled back against its stop 28 by the trigger spring 23. This movement of the trigger moves the driving pawl away from the punch 14 and moves its curved surface at 112 against the tapered side of the ratchet tooth 96, whereby the pawl is forced out of the first ratchet groove 93. As the trigger approaches its normal position against the stop 28, the portion 117 of the pawl is moved by spring 121 into the second rathet groove 94.

The trigger is then squeezed to initiate the second stroke and to force the punch into the key, cutting it to the shape determined by the selected punch and anvil. As the punch moves into the key the main spring 40 is further compressed without moving the cam 11 and the catch pawl 20 is lifted out of groove 105 by engagement with the tapered side of ratchet tooth 107. The tapered surface 48 of the punch may move part way into the anvil during the second stroke. At the end of the second stroke the catch pawl 20 is moved by its spring 121 into the second ratchet groove 106 and the trigger 9 is released to cause the pawl 10 to move into the third ratchet groove 95.

The code cutter of this invention may be designed to provide one or more additional trigger strokes to complete the cut or to cause a finisihing cut to be made. It is preferably a third stroke to complete the cut and to remove the cut metal from the key before the end of the cutting cycle. In the code cutter A shown in the drawings the third pull on the trigger causes the pawl 10 to engage the ratchet tooth 97 and advances the punch 14 into the opening 52 of the anvil 15 so that the entire end surface 48 is located in the anvil. This assures that the cut is complete.

When the trigger is released at the end of the third stroke the catch pawl 20 moves back into the second ratchet groove 106 to prevent further retraction of the punch rod 8. A third ratchet groove may be provided for the catch pawl but is not needed in the cutter A.

After the first cut has been completed, the trip handle 120 is pressed by the thumb to swing the trip lever 130 into engagement with the pawls 10 and 20 and to release the pawls from the punch rod. This allows the punch rod to be retracted by the mainspring 40, releasing the cam 11 and the cam lock 13 from the follower 12 and allowing the lift springs 65 to raise the cam-set holder 6. This completes the first cutting cycle.

Before initiating the second cutting cycle, the shifter handle S at the front of the cutter A is moved to shift the holder 6 and its detent spring d to the next "click" (notch) on the key holder h. The cutter A has a weight of 5 pounds or less and is designed to be held in one hand by the handgrip 17 and the trigger 9 while the other hand is used to support part of the weight and to move the shifter S to indexed positions as required.

The operations necessary for cutting of a key blank after setting the code on the cams 100 are simple and can be performed in a minimal period of time. With a key blank b clamped in position with its associated key holder h and ready to be cut, the operator should (1) squeeze the trigger to begin the cycle and release, (2) squeeze the trigger again and release, (3) squeeze the trigger a third time and release, (4) press the trip handle 120, and (5) index the shifter S to the next "click" on the key holder to complete one cycle. The cycle is repeated until all of the required cuts have been made. The trip handle 120 is preferably pressed by the thumb at the end of each cutting cycle without releasing the trigger 9. The total time for the above manual operations after setting of the code is fraction of the time required for a skilled operator to cut an identical key blank on a typical electric rotary code cutting machine. It is expected that the cutting operations can be carried out at least twice as fast with the hand-operated code cutter of this invention.

It will be understood that two pulls of the trigger 9 are sufficient when making shallow cuts in the key blank because at least two-thirds of the inclined surface 48 of the punch projects into the anvil 15 at the end of the second stroke. The third stroke is not needed and may be omitted except when making deeper cuts. The third stroke removes the chip remaining at the end of the second stroke when making a deep cut in the key blank.

In the house-key code cutter A shown herein the overall stroke of the punch after three pulls of the trigger is in the range of from 0.4 to 0.7 inch and preferably from 0.5 to 0.6 inch. The pivotal axes of the parallel pivot shafts 116 and 125 (FIG. 20) are spaced apart from 0.1 to 0.3 inch and preferably from 0.15 to 0.25 inch in a gun of the type shown where the trigger 9 swings from 60 to 80 degrees. As shown in the drawings, such spacing is about three-sixteenths of an inch and the overall stroke of the punch is about nine-sixteenths of an inch.

The length of the punch stroke and the amount of vertical movement of the cam-set holder are primary factors in determining the optimum location of the follower 12 and the slope of the cam surface 64 (FIG. 5). Such slope is from 30 to 40 degrees and preferably from 34 to 36 degrees in the cutter A shown in the drawings. As shown the slope of surface 64 relative to a horizontal plane is 35 degrees and the slope of locking surface 68 is 38 degrees (FIG. 14A).

The spacing of the ratchet teeth 96 and 97 depends, of course, on the length of stroke. The teeth must be properly located relative to the pawl 10 when the trigger is in its released position. The initial position of such teeth relative to the pawl is precisely set by adjusting the screw stop 21 and adjusting the position of the trigger stop 28.

In order to obtain precision cutting, the punch 14 must be precisely aligned with the opening 52 of the anvil 15. The clearance between the punch and the anvil should be no more than 0.002 inch and is preferably about 0.001 inch. A high degree of precision can be obtained by pairing the punches and anvils in fitted sets.

The code cutter A shown in the drawings is designed to cut keys with the precision required for the vast majority of modern cylinder locks made in this country. It can readily cut keys within a relatively small tolerance range, such as 0.007 inch, as required by some security locks.

The high precision requires that the adjusting pin 30 and the notched cams of the selected cam set 100 are formed to exact sizes. The upper end of said pin is preferably rounded or generally hemispherical and all of the notches n of the cams c are identical in size and are preferably generally semicylindrical or of a size and shape to allow the pin 30 to seat at the proper distance from the axis of the cam-set pin 79 (FIG. 5). High precision is achieved because of the ability of the loosely mounted pin 30 to deflect to the extent necessary to seat properly in the appropriate notch n of the selected cam c.

When a particular brand of cylinder lock requires a key cut with a high degree of precision, it may be important to make a micro adjustment in the position of the pin 30 by turning the set screw 42 (FIG. 24) a predetermined amount with a suitable wrench using the indicia on the dial of the plate 50. Information as to the preferred adjusted position of the pin 30 for each brand of cylinder lock can be provided to the locksmith in addition to information as to key codes. It may become desirable to provide detailed information to assist the locksmith in code selection or in adjustment of the cutter, and computers can be used to assist in this, if desired.

Proper adjustment of the stop pin 30 makes it possible to select the depth of cut precisely and substantially reduces the possibility that the cut key will not perform properly in the lock. The adjustment feature is particularly important in servicing high security locks where the tolerance range is low (e.g., 0.005 or 0.007 inch).

In the more difficult keying operations it may sometimes be desirable to employ trial-and-error methods or custom-fitting procedures. For example, it may be desirable to cut several key blanks to find one key which meets the tolerance requirements or which performs well or to make more than one adjustment of the stop pin 30 to find the proper depth for each cut. The adjustability of the stop pin improves the versatility of the code cutter A as well as its accuracy and reliability for normal high-speed code cutting operations.

While replaceable cam sets, such as the cam sets 100, are preferred because of their accuracy and reliability, it will be understood that the code cutter of this invention can be used with other depth-of-cut gauging means. Such gauging means may supplement or replace the cam sets 100 and may be employed by the locksmith to increase the versatility of the cutter. An alternate form of depth gauging means is disclosed, for example, in U.S. Pat. No. 4,562,759.

The shape of the cams c of the cam sets 100 may vary but the upper portion of each cam which engages the detent spring 89 (FIG. 7) is preferably about the same radius or generally concentric to the pin 79 so that there is no reason to replace the detent spring when changing cam sets. The notches m in the upper portion of each cam which engage the detent spring need not be the same size as the notches n which engage the stop pin 30. The cam c are conventional, and the showing thereof in FIGS. 1, 2 and 5 is schematic and not intended to be an accurate reproduction. For example, the notches m and n of each cam c may be closely spaced to provide 6 to 10 notches per inch, if desired.

The wedging cam lock 13 is reliable and highly advantageous because of the quick release when the trip lever 120 is pressed at the end of each cut. However, other releasable locking means may be employed to lock the key holder and carriage in position during key cutting.

The handle casting 3, the slide block 4 and various other parts of the code cutter A shown herein can be formed partly or entirely of synthetic resins or other materials. Various injection molded plastics are suitable. If desired molded plastics may also be used to cover or enclose portions of the code cutter.

It will be understood that the key cutter shown and described herein for purposes of illustration may be modified and that improvements are to be expected. Variations and modifications of the specific devices shown herein may be made without departing from the spirit of the invention.

Having described my invention, I claim:

1. A portable house-key code cutter having a body, a reciprocating punch rod mounted for limited axial movement in said body and having a key-shearing punch at its forward and, an anvil having an aperture in alignment with said punch, a hand lever pivotally mounted on said body, a track support mounted for upward and downward movement on said body, means for lowering said track support in response to advancing movement of said punch rod, a cam-set holder including a carriage mounted for transverse movement on said support and having means for supporting a key blank in a position to be cut by said punch, several spaced grooves in said punch rod including a forward groove and an intermediate groove defining a plurality of ratchet teeth, a force-multiplying drive pawl having an end portion sequentially engageable with each ratchet tooth, first stop means for locating said rod to permit said last-named end portion to enter the forward groove when said hand lever is in its forward released position, second stop means for locating said rod to permit said last-named end portion to enter the intermediate groove when the hand lever is returned to said forward position and the punch is adjacent the key blank, and means responsive to pivotal movement of said hand lever for causing said driving pawl to move the punch axially against the key blank and force it part way through the blank towards said anvil.

2. A portable key cutter according to claim 1 wherein said second stop means includes a catch pawl pivotally mounted on said body and engaging said punch rod.

3. A portable key cutter according to claim 2 wherein means are provided for releasing said driving pawl and said catch pawl including a trip lever pivotally mounted on said body for movement into engagement with said pawls and exterior finger-operated means for operating said trip lever.

4. A portable key cutter according to claim 1 wherein an adjustable stop member is provided to locate said hand lever in said released position and yieldable means are provided for biasing the lever toward said stop member.

5. A portable key cutter according to claim 1 wherein said body includes a rigid upright portion having a cylindrical opening and a bushing that fits and guides the punch to hold it in precise alignment with the opening of said anvil and wherein an adjustable punch guide mounted on said upright portion engages the upper portion of the punch to prevent turning relative to said anvil.

6. A portable key cutter according to claim 1 wherein said hand lever has an upper portion in the form of a yoke which receives said driving pawl and side plates at opposite sides of said pawl, said pawl having a pivot rod extending between said side plates, and wherein said yoke is pivotally mounted on said body by stub pins adjacent said pivot rod.

7. A portable key cutter according to claim 1 wherein means are provided for lowering said track support including a cam lever pivotally mounted on said body and yieldable means for actuating the cam lever in response to axial movement of said punch.

8. A portable key cutter according to claim 7 wherein a releasable cam lock is provided for engaging the cam lever to maintain the cam-set-holder in a fixed lower position during cutting of the key blank.

9. A portable key cutter according to claim 5 wherein a vertical stop pin is mounted on said body and adjustable depth-of-cut gauging means are carried by said cam-set holder to limit the downward movement of said holder, said gauging means including a series of axially spaced cams having peripheral notches to receive said stop pin and wherein said stop pin is encased in a deformable polymeric material to facilitate seating of the pin in the proper position at the bottom of each notch.

10. A portable key cutter according to claim 1 wherein means are provided for lowering said track support including a cam lever pivotally mounted on said body and having a front portion operably connected to said support and a rear follower, a cam mounted to move axially on said punch rod and having an inclined surface which moves into engagement with said follower when the punch rod is advanced, and a releasable cam lock mounted to move axially on said punch rod and yieldably connected to said cam, said cam lock being pulled by the cam into engagement with said follower and holding the track support in a fixed lowered position during key cutting.

11. A portable house-key code cutter according to claim 1 wherein said axially spaced grooves comprise a forward groove, an intermediate groove and a rear groove defining two ratchet teeth; said hand lever is pivotally mounted on said body to swing about a pivot axis below said punch rod, said driving pawl is pivotally mounted on said hand lever near the pivot axis thereof, and said anvil has a key-engaging face and an aperture of a size to fit said punch.

12. In a portable code key cutter having a body with a depending handgrip portion, a punch rod mounted for limited axial movement in said body and having a key-shearing punch at the forward end of said rod, an anvil carried by said body having an aperture in alignment with said punch, means for reciprocating said rod including a hand lever pivotally mounted on said body, a track support, a carriage mounted on said support for transverse movement to preselected indexed positions, means on said carriage for supporting a key blank, said track support being mounted on said body for vertical movement to advance the key blank into the path of cutting movement of said punch, and adjustable depth-of-cut gauging means on said carriage for limiting the downward movement of said support to locate the key in a selected target position relative to said anvil, the improvement which comprises several axially spaced grooves in said punch rod defining a plurality of ratchet teeth, a force-multiplying driving pawl having a tooth-engaging end portion which enters each of said grooves to advance the punch toward said anvil in response to movement of said hand lever, releasable means for resisting retraction of said punch when the driving pawl approaches its forward position, yieldable means for lowering said support in response to advancing movement of said punch comprising a cam lever pivotally mounted on said body with its forward end portion operably connected to said support, and means connected between said rod and the rear end portion of said cam lever for causing upward movement of said rear end portion when said rod is advanced.

13. A portable key cutter according to claim 12 wherein said yieldable means for lowering said support comprises a cam lever pivotally mounted on said body with its forward end portion operably connected to said track support and means connected between said rod and the rear end portion of said cam lever for causing upward movement of said rear portion when said punch rod is advanced.

14. A portable key cutter according to claim 13 wherein said cam lever has a rear follower, said last-named means comprises a cam mounted to move axially on said punch rod and having an inclined surface which engages said follower when the punch rod is advanced, said surface being inclined at an angle of from 30 to 40 degrees relative to a horizontal plane containing the axis of the punch rod.

15. A portable key cutter according to claim 14 wherein a releasable cam lock is mounted to move axially on said punch rod into engagement with said follower, said cam lock having a follower-engaging surface which is inclined from about 2 to 5 degrees relative to the inclined follower-engaging surface of said cam.

16. A portable key cutter according to claim 15 wherein a lift spring is provided at the forward end of the cam lever to resist lowering of said track support, a main compression spring is provided between said cam and the rear portion of said punch rod, and a tension spring is provided between said cam and the rear portion of said cam lock to pull the cam lock into engagement with said follower when the cam is advanced.

17. A high-speed precision house-key code cutter comprising a body with a handgrip portion, a punch rod mounted for axial reciprocation in said body and having a key-shearing punch at its forward end, an anvil carried by said body having an aperture which fits and receives said punch, a finger-operated hand lever pivotally mounted on said body to swing toward and away from said hand grip portion, a track support mounted for vertical movement on said body, adjustable depth-of-cut gauging means including a cam-set holder having a carriage mounted for lateral sliding movement on said track support and having a key holder for supporting a key blank in a position to be cut by said punch when the track support is lowered, a cam lever pivotally mounted on said body and having a front portion, operably connected to said track support and a follower at its rear end, a cam mounted for axial sliding movement on said punch rod and having an inclined surface for engaging said follower to effect lowering of the track support by said cam lever, spring means carried by said punch rod and engaging the rear portion of said cam for biasing the cam toward said follower, locking means for holding the cam lever in a fixed position after said follower is raised by said cam, a series of axially spaced grooves in the lower portion of said punch rod defining two ratchet teeth, means for advancing the punch including a force-multiplying driving pawl pivotally mounted on said hand lever for engaging each of said ratchet teeth, a pair of axially spaced grooves in the upper portion of said punch rod defining a ratchet tooth, a catch pawl pivotally mounted on said body to swing into and out of said last-named grooves, said catch pawl preventing retraction of the punch by said spring means when the hand lever is released, and a manually-operated trip lever pivotally mounted on said body for moving into engagement with said pawls to release the punch rod.

18. A portable house-key code cutter according to claim 12 wherein said hand lever is pivotally mounted to swing about a first pivot axis below said punch rod, and said driving pawl is pivotally mounted on said hand lever to turn about a pivot axis near and parallel to said first pivot axis.

19. In a portable code key cutter of the character described having a body, a punch rod mounted for limited axial movement in said body and having a key-shearing punch at the forward end of said rod, an anvil carried by said body having an aperture in alignment with said punch to effect shearing of a key blank, means for reciprocating said rod, means for supporting a key blank and for advancing the key blank to said anvil and into the path of cutting movement of said punch, and adjustable depth-of-cut gauging means for limiting the downward movement of the key-supporting means to locate the key in selected target positions relative to said anvil, the improvement which comprises: pawl-and-ratchet means for forcing said punch into said anvil including several axially spaced grooves in said punch rod defining ratchet teeth, and a driving pawl having a tooth-engaging end portion which enters each of said grooves to advance the punch rod toward said anvil; releasable means for resisting retraction of said punch when the driving pawl approaches its forward positions; and means for lowering said key-supporting means in response to advancing movement of said punch rod.

* * * * *